US011401055B2

(12) United States Patent
Johnson et al.

(10) Patent No.: US 11,401,055 B2
(45) Date of Patent: Aug. 2, 2022

(54) SYSTEM AND METHOD FOR FILLING A CHAMBERED PACKAGE

(71) Applicant: Church & Dwight Co., Inc., Princeton, NJ (US)

(72) Inventors: Thomas Johnson, Hightstown, NJ (US); Jonathan Wharton, Ewing, NJ (US); Christopher King, Hampton, NJ (US); Carl Henry, Newtown, PA (US); Eddie A. Roman, Wrightstown, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 17/253,516

(22) PCT Filed: Jun. 20, 2019

(86) PCT No.: PCT/IB2019/055224

§ 371 (c)(1),
(2) Date: Dec. 17, 2020

(87) PCT Pub. No.: WO2019/244103

PCT Pub. Date: Dec. 26, 2019

(65) Prior Publication Data

US 2021/0269179 A1 Sep. 2, 2021

Related U.S. Application Data

(60) Provisional application No. 62/688,617, filed on Jun. 22, 2018.

(51) Int. Cl.
*B65B 1/10* (2006.01)
*B65B 1/36* (2006.01)
(Continued)

(52) U.S. Cl.
CPC ..... *B65B 1/363* (2013.01); *B65B 1/10* (2013.01); *B65B 1/28* (2013.01); *B65B 3/305* (2013.01); *B65B 9/042* (2013.01); *B65B 39/145* (2013.01)

(58) Field of Classification Search
CPC .. B65B 1/363; B65B 1/10; B65B 1/28; B65B 1/04; B65B 3/305; B65B 3/18; B65B 3/04; B65B 9/042; B65B 39/145
See application file for complete search history.

(56) References Cited

U.S. PATENT DOCUMENTS 2,513,852 A * 7/1950 Donofrio ..... A61J 3/07 53/454
3,038,282 A 6/1962 Hansen et al.
(Continued)

FOREIGN PATENT DOCUMENTS

CN 201756119 3/2011
CN 201756199 3/2011
(Continued)

OTHER PUBLICATIONS

Office Action dated Oct. 11, 2021 for corresponding Chinese Application No. 201980041771.6.

*Primary Examiner* — Nicolas A Arnett
(74) *Attorney, Agent, or Firm* — Church & Dwight Co., Inc.

(57) ABSTRACT

A system for filling a chambered package includes a carrying mechanism travelling in a machine direction and having chambered recesses defined about a surface thereof, a first dispensing nozzle configured to dispense a quantity of a medium onto the surface of the carrying mechanism for direction into the chambered recesses in a first group of the chambered recesses defined about the surface of the carrying mechanism, and a first wiper blade disposed along the carrying mechanism in the machine direction after the first
(Continued)

dispensing nozzle, the first wiper blade defining a curvilinear surface having crests configured to direct the quantity of the medium into the chambered recesses in the first group of the chambered recesses and troughs configured to direct the quantity of the medium away from entering the chambered recesses in the second group of the chambered recesses.

18 Claims, 9 Drawing Sheets

(51) Int. Cl.

| | |
|---|---|
| ***B65B 9/04*** | (2006.01) |
| ***B65B 1/28*** | (2006.01) |
| ***B65B 3/30*** | (2006.01) |
| ***B65B 39/14*** | (2006.01) |

(56) References Cited

U.S. PATENT DOCUMENTS

| | | | | |
|---|---|---|---|---|
| 3,107,702 | A | 10/1963 | Gex et al. | |
| 3,218,776 | A * | 11/1965 | Cloud | B65B 47/10 53/453 |
| 3,554,412 | A | 1/1971 | Hayashi et al. | |
| 4,139,613 | A | 2/1979 | Hefele | |
| 4,404,787 | A * | 9/1983 | Hazelwood | B65B 1/366 53/502 |
| 4,571,924 | A | 2/1986 | Bahrani | |
| 5,074,102 | A * | 12/1991 | Simpson | B65B 9/04 53/454 |
| 5,081,819 | A * | 1/1992 | Cloud | B65B 1/366 53/453 |
| 5,187,921 | A | 2/1993 | Wilson et al. | |
| 5,755,077 | A * | 5/1998 | Benham | A21C 11/00 426/125 |
| 5,846,588 | A * | 12/1998 | Zimmermann | A23P 30/10 426/420 |
| 6,779,317 | B2 | 8/2004 | Wilhelm et al. | |
| 6,799,409 | B2 * | 10/2004 | Altvater | A01J 21/02 53/122 |
| 7,661,248 | B2 * | 2/2010 | Conti | B65B 29/025 53/529 |
| 7,661,447 | B2 * | 2/2010 | Bailey | B65B 1/363 141/12 |
| 8,127,516 | B2 | 3/2012 | Lee et al. | |
| 8,539,743 | B2 * | 9/2013 | Rapparini | B65B 31/028 53/561 |
| 8,662,880 | B2 * | 3/2014 | Fowler | B65B 3/04 425/388 |
| 8,997,799 | B2 | 4/2015 | Hodson et al. | |
| 9,433,559 | B2 * | 9/2016 | Puckett | A61K 9/4825 |
| 10,273,027 | B2 * | 4/2019 | Kepinski | B65B 47/10 |
| 10,702,894 | B2 * | 7/2020 | Brandt Sanz | B08B 5/043 |
| 10,974,412 | B2 * | 4/2021 | Waterman | B65B 47/10 |
| 2005/0000192 | A1 | 1/2005 | Aylward | |
| 2009/0199513 | A1 | 8/2009 | Oyler et al. | |
| 2012/0324829 | A1 | 12/2012 | Omura et al. | |
| 2016/0114914 | A1 | 4/2016 | Kepinski et al. | |
| 2019/0337650 | A1 * | 11/2019 | Johnson | B65B 61/06 |

FOREIGN PATENT DOCUMENTS

| | | |
|---|---|---|
| CN | 102369056 | 3/2012 |
| CN | 106314840 | 1/2017 |
| EP | 0 127 267 | 12/1984 |
| EP | 1702843 B1 | 8/2008 |
| JP | 05132017 A | 5/1993 |
| KR | 20160126768 | 11/2016 |
| TW | 469245 | 12/2001 |

* cited by examiner

SYSTEM AND METHOD FOR FILLING A CHAMBERED PACKAGE

FIELD OF THE DISCLOSURE

The present disclosure relates to a system and method for filling a chambered package. More particularly, the present disclosure relates to a system and method for automatically filling a chambered package for use in laundry and dishwashing applications.

BACKGROUND

Various types of chambered packages (e.g., unit dose packs, pods, cavity tablets, etc.) have been used for many years in the area of household care to provide a single-use, pre-dosed quantity of detergent in laundry and dishwashing applications. These types of chambered packages are generally formed from webs of film material that are in some way bonded together to form chambered recesses enclosing detergent provided within. In some of the chambered packages, different types of detergents are provided in different chambered recesses within the package to provide various cleaning effects throughout the laundry and/or dishwashing application. For example, a two chambered package may include detergent broken up into two different components: a first component (e.g., powder, liquid, slurry, or gel) in one chambered recess and a second, different component (e.g., powder, liquid, slurry, or gel) in a second chambered recess, where only during the laundry or dishwashing application do the two components intermix. In another example, a single chambered package may include a powder, liquid, or gel detergent disposed within a single chambered recess.

When filling the chambered packages with a powder component in particular, a critical to quality (CTQ) attribute, which takes considerable effort to minimize due to the powder component's innate physical properties, is the presence of powder in any region other than a desired chambered recess within the chambered package. Current techniques that are employed in filling chambered packages with powder components may include, for example, vacuum systems, wiper assemblies, and custom dispensing nozzles in order to "clean" the film areas that are to be bonded together and remove powder components from chambered recesses that are to be filled with other detersive formulas (e.g., liquid components, gel components, slurry components, other powder components, etc.)

However, these current techniques tend to be problematic. For example, current vacuum systems require a detailed maintenance schedule and often result in higher levels of product scrap and higher operating costs. In another example, current wiper assemblies may be unable to precisely direct the detergent into the chambered recesses which often results in increased product scrap. In addition, a complexity of current wiper assemblies often results in increased frequency of maintenance. In a still further example, custom dispensing nozzles generally require a long lead time for design and production purposes, and any design changes necessarily require additional costs, which then limit design flexibility and operational ranges.

Accordingly, there remains a need for an improved system and method for filling chambered packages, which addresses at least some of the issues described above.

SUMMARY OF THE DISCLOSURE

The present disclosure relates to systems and methods for filling chambered packages. In some aspects, a system for filling a chambered package may comprise a carrying mechanism travelling in a machine direction and having chambered recesses defined about a surface thereof; a first dispensing nozzle configured to dispense a quantity of a medium onto the surface of the carrying mechanism for direction into the chambered recesses in a first group of the chambered recesses defined about the surface of the carrying mechanism; and a first wiper blade disposed along the carrying mechanism in the machine direction after the first dispensing nozzle, the first wiper blade defining a curvilinear surface having crests with peaks aligned with centerlines of the chambered recesses in the first group of the chambered recesses, the centerlines being parallel to the machine direction, the crests being configured to direct the quantity of the medium into the chambered recesses in the first group of the chambered recesses, and the curvilinear surface having troughs with apices tangential to a midpoint of a width in a cross-machine direction of the chambered recesses in a second group of the chambered recesses, the troughs being configured to direct the quantity of the medium away from entering the chambered recesses in the second group of the chambered recesses.

A second wiper blade may be disposed along the carrying mechanism in the machine direction before the first dispensing nozzle, the second wiper blade defining a curvilinear surface that is mirrored in the cross-machine direction relative to the first wiper blade so as to contain the quantity of the medium in the chambered recesses in the first group of the chambered recesses.

The curvilinear surface of the second wiper blade has crests with peaks aligned with the centerlines of the chambered recesses in the second group of the chambered recesses, the centerlines being parallel to the machine direction, the crests being configured to contain the quantity of the medium in the chambered recesses in the first group of the chambered recesses, and the curvilinear surface of the second wiper blade has troughs with apices tangential to the midpoint of the width in the cross-machine direction of the chambered recesses in the first group of the chambered recesses.

A second dispensing nozzle may be disposed along the carrying mechanism in the machine direction before the first dispensing nozzle and the second wiper blade, the second dispensing nozzle being configured to dispense a quantity of a medium on the surface of the carrying mechanism for direction into the chambered recesses in the second group of the chambered recesses defined about the surface of the carrying mechanism, wherein the crests of the second wiper blade are configured to direct the quantity of the medium dispensed from the second dispensing nozzle into the chambered recesses in the second group of the chambered recesses and the troughs of the second wiper blade are configured to direct the quantity of the medium dispensed from the second dispensing nozzle away from entering the chambered recesses in the first group of the chambered recesses, and wherein the second group of the chambered recesses is different than the first group of the chambered recesses.

A third wiper blade may be disposed along the carrying mechanism in the machine direction before the second dispensing nozzle, the third wiper blade defining a curvilinear surface in alignment with the first wiper blade and mirrored in the cross-machine direction to the second wiper blade so as to contain the quantity of the medium dispensed from the second dispensing nozzle in the chambered recesses in the second group of the chambered recesses.

The curvilinear surface of the third wiper blade may have crests with peaks aligned with centerlines of the chambered recesses in the first group of the chambered recesses parallel to the machine direction, the crests being configured to contain the quantity of the medium in the chambered recesses in the second group of the chambered recesses, and the curvilinear surface of the third wiper blade has troughs with apices tangential to the midpoint of the width of each of the chambered recesses in the second group of the chambered recesses in the cross-machine direction.

The curvilinear surface of the first wiper blade my comprise an amplitude of at least half a length of each of the chambered recesses relative to the machine direction, and comprises a wavelength at most a width of each of the chambered recesses relative to the cross-machine direction.

The curvilinear surface of the first wiper blade may define a sinusoidal waveform.

The carrying mechanism may comprise a rotating drum having a cylindrical surface or the carrying mechanism comprises a flatbed conveyor having a planar surface.

The first dispensing nozzle may be disposed between about 345 degrees and about 15 degrees relative to a center of the cylindrical surface and the first wiper blade is disposed between about 270 degrees and about 90 degrees relative to the center of the cylindrical surface.

The first wiper blade may define three distinct curvilinear surfaces configured to be aligned such that crests of each of the curvilinear surfaces have aligned peaks and troughs of each of the curvilinear surfaces have aligned apices.

The first wiper blade may further define a rectilinear surface extending substantially perpendicularly to the crests and troughs of the curvilinear surface of the first wiper blade in the cross-machine direction, the rectilinear surface being in contact with the peaks of the curvilinear surface.

In some other aspects, a method for filling a chambered package may comprise dispensing a quantity of a medium from a first dispensing nozzle onto a surface of a carrying mechanism travelling in a machine direction for direction into chambered recesses in a first group of the chambered recesses defined about a surface of the carrying mechanism; directing, using a first wiper blade disposed along the carrying mechanism in the machine direction after the first dispensing nozzle, the quantity of the medium into the chambered recesses in the first group of the chambered recesses, the first wiper blade defining a curvilinear surface having crests with peaks aligned with centerlines of the chambered recesses in the first group of the chambered recesses, the centerlines being parallel to the machine direction; and directing the quantity of the medium away from entering chambered recesses in a second group of the chambered recesses using the first wiper blade defining the curvilinear surface having troughs with apices tangential to a midpoint of a width of each of the chambered recesses in the second group of the chambered recesses in a cross-machine direction.

The method may comprise containing the quantity of the medium in the chambered recesses in the first group of the chambered recesses, using a second wiper blade disposed along the carrying mechanism in the machine direction before the first dispensing nozzle, the second wiper blade defining a curvilinear surface that is mirrored in the cross-machine direction relative to the first wiper blade.

Containing the quantity of the medium in the chambered recesses in the first group of the chambered recesses using the second wiper blade may comprise mirroring the curvilinear surface of the second wiper blade relative to the first wiper blade in the cross-machine direction such that the second wiper blade has crests with peaks aligned with the centerlines of the chambered recesses in the second group of the chambered recesses, the centerlines being parallel to the machine direction, the crests being configured to contain the quantity of the medium in the chambered recesses in the first group of the chambered recesses, and the curvilinear surface of the second wiper blade has troughs with apices tangential to the midpoint of the width in the cross-machine direction of the chambered recesses in the first group of the chambered recesses.

The method may comprise dispensing a quantity of a medium from a second dispensing nozzle onto the surface of the carrying mechanism travelling in the machine direction for direction into the chambered recesses in the second group of the chambered recesses defined about the surface of the carrying mechanism; directing, using the second wiper blade, the quantity of the medium dispensed from the second dispensing nozzle into the chambered recesses in the second group of the chambered recesses; and directing the quantity of the medium dispensed from the second dispensing nozzle away from entering the chambered recesses in the first group of the chambered recesses using the troughs of the second wiper blade; wherein the second group of the chambered recesses is different than the first group of the chambered recesses.

The method may comprise containing, using a third wiper blade disposed along the carrying mechanism in the machine direction before the second dispensing nozzle, the quantity of the medium dispensed from the second dispensing nozzle in the chambered recesses in the second group of the chambered recesses, the third wiper blade defining a curvilinear surface in alignment with the first wiper blade and mirrored in the cross-machine direction to the second wiper blade so as to contain the quantity of the medium dispensed from the second dispensing nozzle in the chambered recesses in the second group of the chambered recesses.

Containing the quantity of the medium in the chambered recesses in the second group of the chambered recesses using the third wiper blade may comprise mirroring the third wiper blade in the cross-machine direction relative to the second wiper blade and aligning the third wiper blade in the cross-machine direction with the first wiper blade so that the curvilinear surface of the third wiper blade has crests with peaks aligned with centerlines of the chambered recesses in the first group of the chambered recesses, the centerlines being parallel to the machine direction, the crests being configured to contain the quantity of the medium in the chambered recesses in the second group of the chambered recesses, and the curvilinear surface of the third wiper blade has troughs with apices tangential to the midpoint of the width of each of the chambered recesses in the second group of the chambered recesses in the cross-machine direction.

The present disclosure thus includes, without limitation, the following embodiments:

Embodiment 1: A system for filling a chambered package, the system comprising: a carrying mechanism travelling in a machine direction and having chambered recesses defined about a surface thereof; a first dispensing nozzle configured to dispense a quantity of a medium onto the surface of the carrying mechanism for direction into the chambered recesses in a first group of the chambered recesses defined about the surface of the carrying mechanism; and a first wiper blade disposed along the carrying mechanism in the machine direction after the first dispensing nozzle, the first wiper blade defining a curvilinear surface having crests with peaks aligned with centerlines of the chambered recesses in the first group of the chambered recesses, the centerlines being parallel to the machine direction, the crests being configured to direct the quantity of the medium into the chambered recesses in the first group of the chambered recesses, and the curvilinear surface having troughs with apices tangential to a midpoint of a width in a cross-machine direction of the chambered recesses in a second group of the chambered recesses, the troughs being configured to direct the quantity of the medium away from entering the chambered recesses in the second group of the chambered recesses.

Embodiment 2: The system of any preceding embodiment, or any combination of preceding embodiments, the system further comprising a second wiper blade disposed along the carrying mechanism in the machine direction before the first dispensing nozzle, the second wiper blade defining a curvilinear surface that is mirrored in the cross-machine direction relative to the first wiper blade so as to contain the quantity of the medium in the chambered recesses in the first group of the chambered recesses.

Embodiment 3: The system of any preceding embodiment, or any combination of preceding embodiments, wherein the curvilinear surface of the second wiper blade has crests with peaks aligned with the centerlines of the chambered recesses in the second group of the chambered recesses, the centerlines being parallel to the machine direction, the crests being configured to contain the quantity of the medium in the chambered recesses in the first group of the chambered recesses, and the curvilinear surface of the second wiper blade has troughs with apices tangential to the midpoint of the width in the cross-machine direction of the chambered recesses in the first group of the chambered recesses.

Embodiment 4: The system of any preceding embodiment, or any combination of preceding embodiments, the system further comprising a second dispensing nozzle disposed along the carrying mechanism in the machine direction before the first dispensing nozzle and the second wiper blade, the second dispensing nozzle being configured to dispense a quantity of a medium on the surface of the carrying mechanism for direction into the chambered recesses in the second group of the chambered recesses defined about the surface of the carrying mechanism, wherein the crests of the second wiper blade are configured to direct the quantity of the medium dispensed from the second dispensing nozzle into the chambered recesses in the second group of the chambered recesses and the troughs of the second wiper blade are configured to direct the quantity of the medium dispensed from the second dispensing nozzle away from entering the chambered recesses in the first group of the chambered recesses, and wherein the second group of the chambered recesses is different than the first group of the chambered recesses.

Embodiment 5: The system of any preceding embodiment, or any combination of preceding embodiments, the system further comprising a third wiper blade disposed along the carrying mechanism in the machine direction before the second dispensing nozzle, the third wiper blade defining a curvilinear surface in alignment with the first wiper blade and mirrored in the cross-machine direction to the second wiper blade so as to contain the quantity of the medium dispensed from the second dispensing nozzle in the chambered recesses in the second group of the chambered recesses.

Embodiment 6: The system of any preceding embodiment, or any combination of preceding embodiments, wherein the curvilinear surface of the third wiper blade has crests with peaks aligned with centerlines of the chambered recesses in the first group of the chambered recesses parallel to the machine direction, the crests being configured to contain the quantity of the medium in the chambered recesses in the second group of the chambered recesses, and the curvilinear surface of the third wiper blade has troughs with apices tangential to the midpoint of the width of each of the chambered recesses in the second group of the chambered recesses in the cross-machine direction.

Embodiment 7: The system of any preceding embodiment, or any combination of preceding embodiments, wherein the curvilinear surface of the first wiper blade comprises an amplitude of at least half a length of each of the chambered recesses relative to the machine direction, and comprises a wavelength at most a width of each of the chambered recesses relative to the cross-machine direction.

Embodiment 8: The system of any preceding embodiment, or any combination of preceding embodiments, wherein the curvilinear surface of the first wiper blade defines a sinusoidal waveform.

Embodiment 9: The system of any preceding embodiment, or any combination of preceding embodiments, wherein the carrying mechanism comprises a rotating drum having a cylindrical surface or the carrying mechanism comprises a flatbed conveyor having a planar surface.

Embodiment 10: The system of any preceding embodiment, or any combination of preceding embodiments, wherein the first dispensing nozzle is disposed between about 345 degrees and about 15 degrees relative to a center of the cylindrical surface and the first wiper blade is disposed between about 270 degrees and about 90 degrees relative to the center of the cylindrical surface.

Embodiment 11: The system of any preceding embodiment, or any combination of preceding embodiments, wherein the first wiper blade defines three distinct curvilinear surfaces configured to be aligned such that crests of each of the curvilinear surfaces have aligned peaks and troughs of each of the curvilinear surfaces have aligned apices.

Embodiment 12: The system of any preceding embodiment, or any combination of preceding embodiments, wherein the first wiper blade further defines a rectilinear surface extending substantially perpendicularly to the crests and troughs of the curvilinear surface of the first wiper blade in the cross-machine direction, the rectilinear surface being in contact with the peaks of the curvilinear surface.

Embodiment 13: A method for filling a chambered package, the method comprising: dispensing a quantity of a medium from a first dispensing nozzle onto a surface of a carrying mechanism travelling in a machine direction for direction into chambered recesses in a first group of the chambered recesses defined about a surface of the carrying mechanism; directing, using a first wiper blade disposed along the carrying mechanism in the machine direction after the first dispensing nozzle, the quantity of the medium into the chambered recesses in the first group of the chambered recesses, the first wiper blade defining a curvilinear surface having crests with peaks aligned with centerlines of the chambered recesses in the first group of the chambered recesses, the centerlines being parallel to the machine direction; and directing the quantity of the medium away from entering chambered recesses in a second group of the chambered recesses using the first wiper blade defining the curvilinear surface having troughs with apices tangential to a midpoint of a width of each of the chambered recesses in the second group of the chambered recesses in a cross-machine direction.

Embodiment 14: The method of any preceding embodiment, or any combination of preceding embodiments, the method further comprising containing the quantity of the medium in the chambered recesses in the first group of the chambered recesses, using a second wiper blade disposed along the carrying mechanism in the machine direction before the first dispensing nozzle, the second wiper blade defining a curvilinear surface that is mirrored in the cross-machine direction relative to the first wiper blade.

Embodiment 15: The method of any preceding embodiment, or any combination of preceding embodiments, wherein containing the quantity of the medium in the chambered recesses in the first group of the chambered recesses using the second wiper blade comprises mirroring the curvilinear surface of the second wiper blade relative to the first wiper blade in the cross-machine direction such that the second wiper blade has crests with peaks aligned with the centerlines of the chambered recesses in the second group of the chambered recesses, the centerlines being parallel to the machine direction, the crests being configured to contain the quantity of the medium in the chambered recesses in the first group of the chambered recesses, and the curvilinear surface of the second wiper blade has troughs with apices tangential to the midpoint of the width in the cross-machine direction of the chambered recesses in the first group of the chambered recesses.

Embodiment 16: The method of any preceding embodiment, or any combination of preceding embodiments, the method further comprising: dispensing a quantity of a medium from a second dispensing nozzle onto the surface of the carrying mechanism travelling in the machine direction for direction into the chambered recesses in the second group of the chambered recesses defined about the surface of the carrying mechanism; directing, using the second wiper blade, the quantity of the medium dispensed from the second dispensing nozzle into the chambered recesses in the second group of the chambered recesses; and directing the quantity of the medium dispensed from the second dispensing nozzle away from entering the chambered recesses in the first group of the chambered recesses using the troughs of the second wiper blade; wherein the second group of the chambered recesses is different than the first group of the chambered recesses.

Embodiment 17: The method of any preceding embodiment, or any combination of preceding embodiments, the method further comprising containing, using a third wiper blade disposed along the carrying mechanism in the machine direction before the second dispensing nozzle, the quantity of the medium dispensed from the second dispensing nozzle in the chambered recesses in the second group of the chambered recesses, the third wiper blade defining a curvilinear surface in alignment with the first wiper blade and mirrored in the cross-machine direction to the second wiper blade so as to contain the quantity of the medium dispensed from the second dispensing nozzle in the chambered recesses in the second group of the chambered recesses.

Embodiment 18: The method of any preceding embodiment, or any combination of preceding embodiments, wherein containing the quantity of the medium in the chambered recesses in the second group of the chambered recesses using the third wiper blade comprises mirroring the third wiper blade in the cross-machine direction relative to the second wiper blade and aligning the third wiper blade in the cross-machine direction with the first wiper blade so that the curvilinear surface of the third wiper blade has crests with peaks aligned with centerlines of the chambered recesses in the first group of the chambered recesses, the centerlines being parallel to the machine direction, the crests being configured to contain the quantity of the medium in the chambered recesses in the second group of the chambered recesses, and the curvilinear surface of the third wiper blade has troughs with apices tangential to the midpoint of the width of each of the chambered recesses in the second group of the chambered recesses in the cross-machine direction.

These and other features, aspects, and advantages of the present disclosure will be apparent from a reading of the following detailed description together with the accompanying drawings, which are briefly described below. The present disclosure includes any combination of two, three, four, or more features or elements set forth in this disclosure or recited in any one or more of the claims, regardless of whether such features or elements are expressly combined or otherwise recited in a specific embodiment description or claim herein. This disclosure is intended to be read holistically such that any separable features or elements of the disclosure, in any of its aspects and embodiments, should be viewed as intended to be combinable, unless the context of the disclosure clearly dictates otherwise.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

Figure 8:
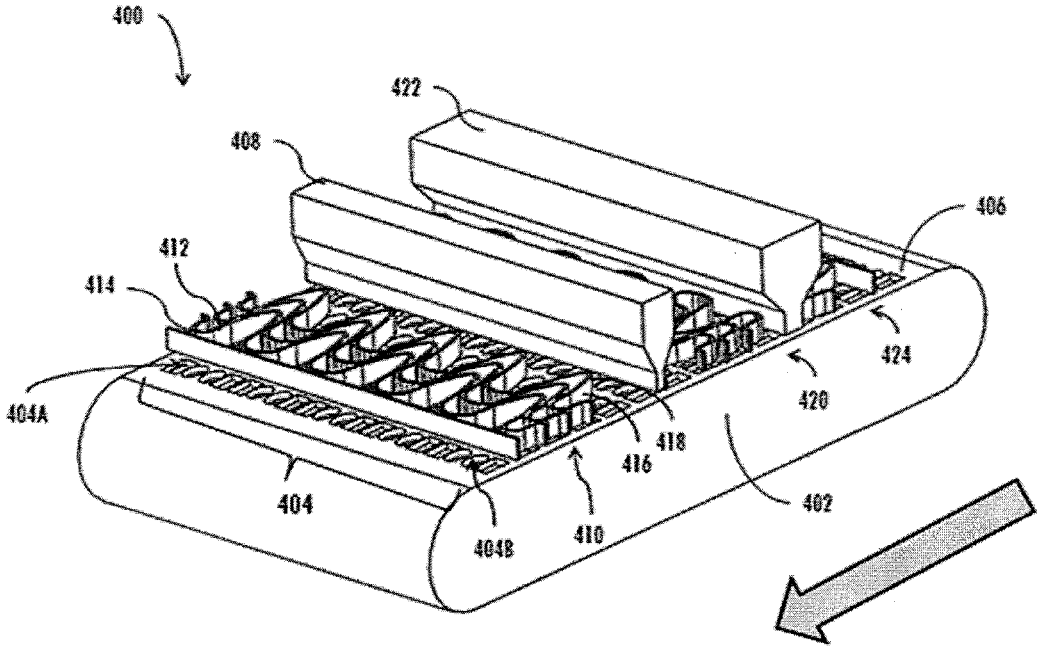
Figure 9:
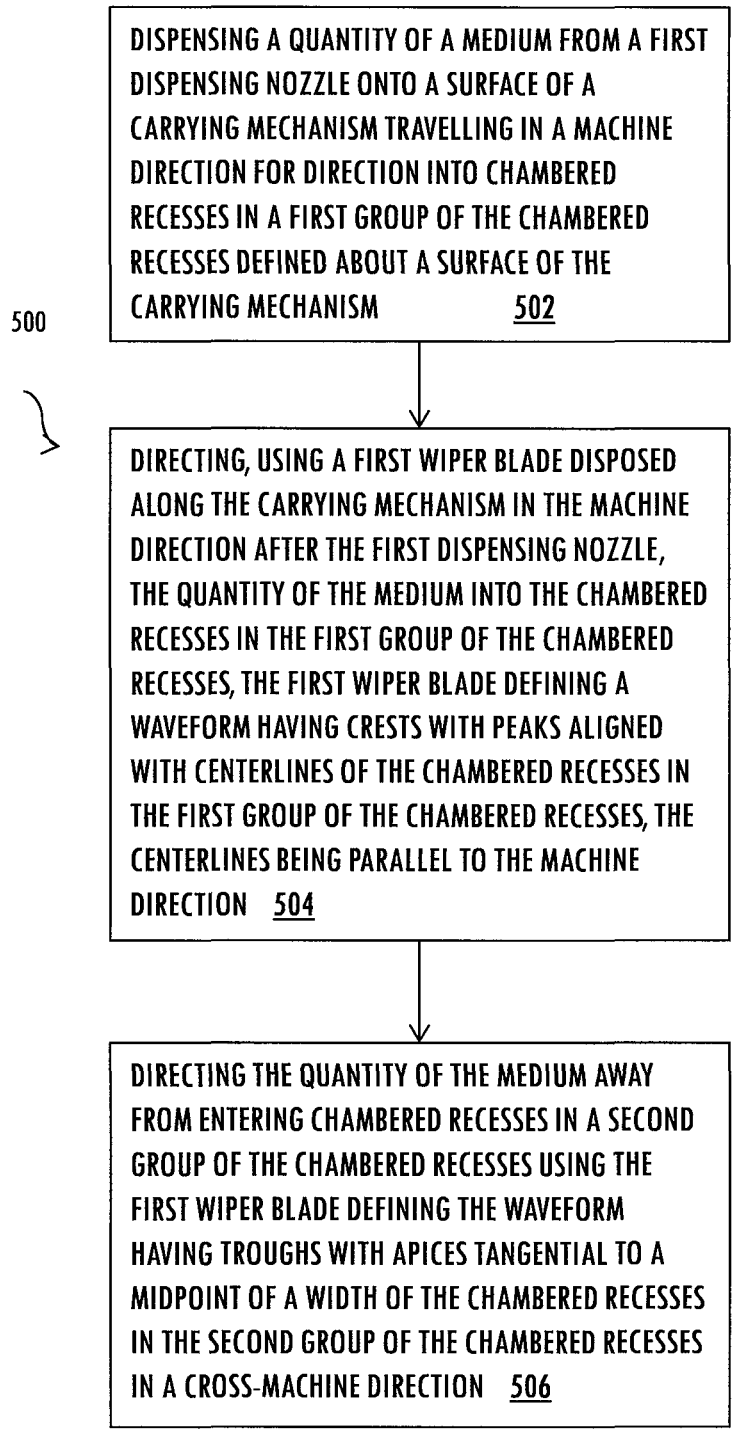

FIG. 8 illustrates an exemplary system for filling a chambered package, where a carrying mechanism is a flatbed conveyor and a wiper blade defines a curvilinear surface configured to direct a quantity of a medium into every two chambered recess according to various aspects of the present disclosure; and FIG. 9 illustrates a flow diagram of a method for filling a chambered package according to various aspects of the present disclosure.

DETAILED DESCRIPTION OF THE DISCLOSURE

The present disclosure now will be described more fully hereinafter with reference to specific embodiments and particularly to the various drawings provided herewith. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a," "an," "the," include plural referents unless the context clearly dictates otherwise.

The present disclosure relates to a system and method for filling a chambered package according to various aspects of the present disclosure. The system and method are utilized for actively directing a quantity of a medium into a first group of chambered recesses defined about a surface of a carrying mechanism and/or actively directing or preventing the quantity of the medium away from entering a second group of the chambered recesses defined about the surface thereof using at least one wiper blade defining a curvilinear surface having crests and troughs relative to a cross-machine direction. Notably, a chambered recess in either the first group or the second group of chambered recesses defined about the surface of the carrying mechanism forms an individual chamber of a chambered package suitable for use in laundry and dishwashing applications. For example, the chambered package is introduced into a detergent cavity in a washing machine or a dishwasher. The chambered package may also be usable in similar applications.

Figure 1:
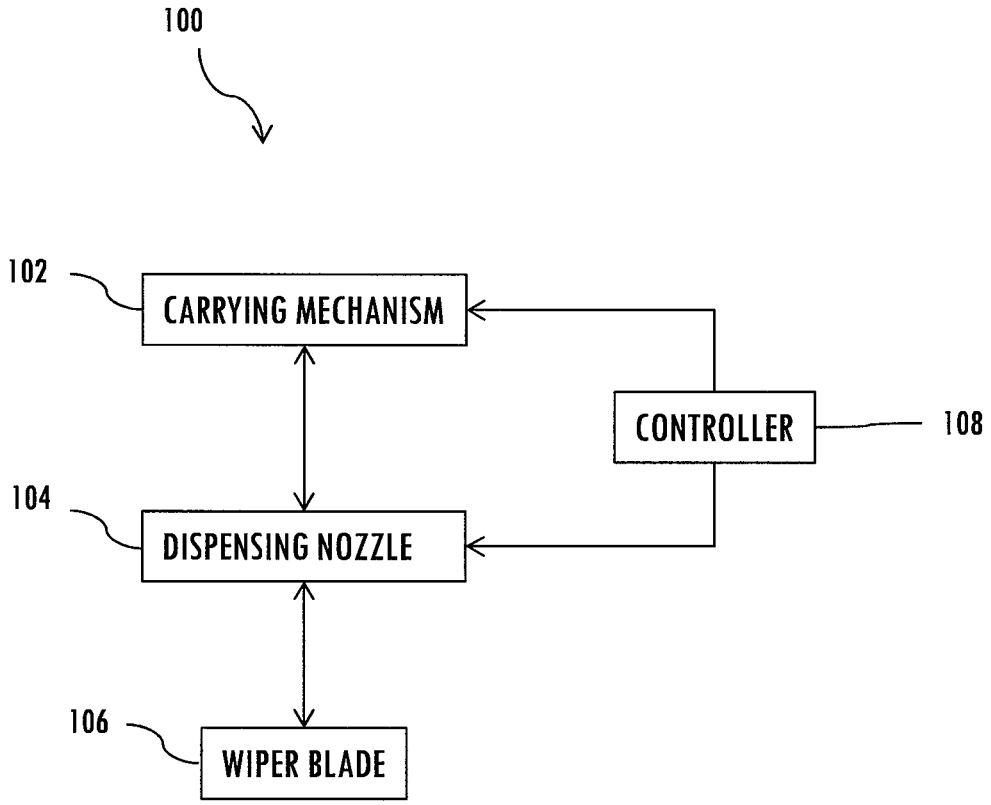
FIG. 1 illustrates a system for filling a chambered package according to various aspects of the present disclosure.

Referring now to FIG. 1, a system diagram 100 of an exemplary system for filling a chambered package is illustrated. The exemplary system includes a carrying mechanism 102, a dispensing nozzle 104, and a wiper blade 106. Other elements of the system may comprise a controller 108. The system may comprise a flood-fill volumetric feed system, an auger fill feed system, or the like.

The carrying mechanism 102 may generally refer to a conveying device travelling in a machine direction that is configured to convey a quantity of a medium in said direction. For example, the carrying mechanism may comprise a rotating drum or some other curved carrying mechanism rotating about a rotational axis and having a cylindrical surface disposed between two opposing end faces. FIGS. 2-7 illustrate various embodiments of rotating drums defining a cylindrical surface having chambered recesses defined therein. The cylindrical surface of the rotating drum extends in a cross-machine direction from a first end face of the rotating drum to a second end face of the rotating drum and defines one, two, three, four, five, six, etc., chambered recesses in parallel rows extending thereabout.

In another example, the carrying mechanism 102 may comprise a flatbed conveyor having a planar surface. FIG. 8 illustrates an example embodiment of a flatbed conveyor defining a planar surface having chambered recesses defined therein. The surface of the flatbed conveyor extends in a cross-machine direction and defines one, two, three, four, five, six, etc., chambered recesses in parallel rows extending thereabout. Other example embodiments of carrying mechanisms are also contemplated.

Regardless of the type of carrying mechanism 102 described herein, chambered recesses may be defined about a surface thereof. The chambered recesses defined about the surface of the carrying mechanism may be defined such that there are a certain number of chambered recesses extending across the cross-machine direction of the surface of the carrying mechanism. Each of these chambered recesses may be configured to receive a quantity of a medium from the dispensing nozzle 104, where the quantity of the medium received therefrom is the same medium or a different medium depending on a location of the chambered recess along the cross-machine direction. For example, every other chambered recess (e.g., a first group of chambered recesses) along the cross-machine direction may be configured to receive a quantity of a medium and the other chambered recesses (e.g., a second group of chambered recesses) are configured to receive a quantity of a medium. This example is illustrated and discussed in more detail in at least FIGS. 2-4. In another example, every other two chambered recesses (e.g., a first group of chambered recesses) receive a quantity of a medium and every other two chambered recesses (e.g., a second group of chambered recesses) receive a quantity of a medium. This example is illustrated and discussed in more detail in at least FIGS. 5-6.

Each of the chambered recesses may be defined as having a width extending in a cross-machine direction and a length extending in the machine direction. A centerline of each of the chambered recesses may be parallel to the machine direction, such that a quantity of the medium directed into the chambered recesses is configured to be directed toward the centerline of the chambered recess. As such, the dispensing nozzle 104 may be aligned with the chambered recesses based on at least the centerline thereof so as to direct a quantity of the medium into the chambered recess.

In some example aspects, the carrying mechanism 102 may be configured to accommodate a web of film material that extends about a surface of the carrying mechanism 104 and is received within the chambered recesses. The web of film material may comprise a flexible, water soluble film material, such as a sheet-like flexible plastic formed of, for example, cellophane, polyethylene, acetates, polyvinyl alcohol (PVA), or the like, which is capable of having individual chambers formed therein, of being sealed and folded, bonded, etc. In some aspects, a forming arrangement (e.g., a vacuum) is configured to interact with the web of film material. More particularly, for example, the forming arrangement is configured to exert a negative pressure through the surface of the carrying mechanism so as to draw the web of film material into the chambered recesses. As such, the carrying mechanism defines chambered recesses having a web of film material drawn into a bottom thereof, in which a quantity of medium may be dispensed.

The dispensing nozzle 104 may generally refer to at least one dispensing nozzle that is statically disposed along the surface of the carrying mechanism in the machine direction and is configured to dispense a quantity of a medium onto the surface of the carrying mechanism 102 for direction into the chambered recesses. Whether the carrying mechanism is a rotating drum, a flatbed conveyor, or any other similar carrying mechanism, the dispensing nozzle may be configured to dispense a pre-determined quantity of the medium into the chambered recesses as the chambered recesses pass under the dispensing nozzle.

In some aspects, the dispensing nozzle is in communication with a hopper or other feed mechanism that feeds the dispensing nozzle the medium. A valve (not shown) or other control mechanism (e.g., controller 108) may be configured to control a flow of the medium received by the dispensing nozzle such that the quantity of the medium dispensed from the dispensing nozzle is metered out based on one or more factors, such as one or more characteristics of the medium, a diameter of the nozzle, a length of the longitudinal opening, a travel speed of the carrying mechanism, a size of the one or more recess, and the like.

The medium dispensed onto the surface of the carrying mechanism 102 may be from the dispensing nozzle, for example, in the form of a powder, a liquid, a gel, a slurry, a plurality of microbeads, or a combination thereof. In some embodiments, the medium may particularly be a detergent composition. The medium thus may comprise, for example, one or more surfactants, bleaching agents, enzymes, bleach activators, corrosion inhibitors, scale inhibitors, cobuilders, dyes and/or perfumes, bicarbonates, soil release polymers, optical brighteners, dye transfer or redeposition inhibitors, defoamers, and/or mixtures thereof. In some aspects, one dispensing nozzle or a plurality of dispensing nozzles may be utilized in the system 100. For example, two dispensing nozzles may be utilized where two different media are dispensed, the same medium is dispensed in different quantities, etc. In other examples, a single dispensing nozzle may be configured to dispense different media from a bifurcated dispensing chute. FIGS. 2-8 illustrate various embodiments of systems having a first dispensing nozzle and a second dispensing nozzle. However, other designs contemplated herein may have three dispensing nozzles, four dispensing nozzles, etc.

Location of the dispensing nozzle 104 may vary along the carrying mechanism 102. Rotary filling design naturally limits location of the dispensing nozzle along the carrying mechanism to the apex of the cylindrical surface of the rotating drum due to gravity. As such, if 0 degrees from the vertical is considered the "center" of a rotating drum, then it may be advantageous to locate the primary or first dispensing nozzle between about 345 degrees and about 15 degrees relative to the center of the cylindrical surface of the rotating drum. Where additional dispensing nozzles are utilized in the system, then it may be advantageous to locate the secondary or second dispensing nozzle between about 0 degrees and about 60 degrees; most advantageously between about 0 degrees and about 45 degrees.

The wiper blade 106 may generally refer to at least one wiper blade that is statically disposed along the carrying mechanism 102 in the machine direction either before or after the dispensing nozzle 104 and is configured to direct the quantity of the medium dispensed onto the surface of the carrying mechanism, which was not dispensed into the chambered recesses, into the chambered recesses. Advantageously, the wiper blade 106 is configured to direct a quantity of the medium into the chambered recesses for which it is intended (e.g., a first group of the chambered recesses) and direct the quantity of the medium away from entering chambered recesses that are not intended to receive the quantity of the medium (e.g., a second group of the chambered recesses). In some additional aspects, the wiper blade is also configured to contain the quantity of the medium in a chambered recess for which it is intended. To this end, the wiper blade defines a curvilinear surface (or any other surface) that complements that intended chambered recess design) in order to direct the quantity of medium into the desired chambered recess, while directing the quantity of medium away from the other chambered recess. As used herein, a "curvilinear surface" is a surface having continuously alternating crests and troughs, which extends in the cross-machine direction of the carrying mechanism. The crests of the curvilinear surface may be configured to coincide with each of the chambered recesses intended to receive the quantity of the medium and peaks of the crests may be configured to align with centerlines of these chambered recesses parallel to the machine direction. The troughs of the curvilinear surface may be configured to coincide with each of the chambered recesses that are not intended for the quantity of the medium and apices of the troughs may be configured to be tangential to a midpoint of a width in a cross-machine direction of these chambered recesses.

In some aspects, for example, the curvilinear surface of the wiper blade 106 comprises an amplitude of at least 0.5 or half a length of each of the chambered recesses relative to the machine direction. Preferably, the curvilinear surface of the wiper blade comprises an amplitude of between about 1 to about 1.5 of a length of each of the chambered recesses relative to the machine direction as this gives sufficient room for the quantity of the medium to be directed into the chamber by the crest of the wiper blade and increases an angle (in respect to cross-machine axis), which makes the wiper blade more efficient. Due to practical space constraints, the amplitude may be limited based on machine design. As the amplitude approaches 0 degrees, the curvilinear surface of the wiper blade becomes a line and loses its ability to effectively guide the formula into the intended chambered recesses. Because of this, a minimum angle of about 5 degrees may be desirable. Conversely, it may be desirable to maintain a maximum angle of the curvilinear surface of the wiper blade at about 90 degrees because as the angle approaches 90 degrees, the curvilinear surface may no longer be able to sufficiently direct the quantity of the medium into the chambered recesses (as it is now parallel with the machine direction). In some aspects, for example, an angle greater than about 45 degrees is beneficial with an angle closer to about 75 degrees being even more beneficial. This angle is based on a tangential line at an inflection point of a curve (on an inside of a guiding edge of the curvilinear surface) and the cross-machine axis.

In some further aspects, the curvilinear surface of the wiper blade may comprise a wavelength that is at most a width of each of the chambered recesses relative to the cross-machine direction. To minimize the occurrence of contamination, the wavelength should be as small as possible, but this may have an inversely negative effect on a flow path for the quantity of the medium (e.g., restricting the flow rate and throughput). To maximize the throughput, it may be beneficial for the wavelength to be between about 85 percent and about 95 percent, and most beneficially about 90 percent. Media that flows uniformly and predictably (e.g., viscous liquids) may extend to the higher end, even close to about 99 percent, but products like non-free flowing powders or granular products, which exhibit unpredictable behavior from bouncing off walls of the chambered recesses and other particles, tend to stay between about 85 percent and about 90 percent. Accordingly, the amplitude and the wavelength of the curvilinear surface of the wiper blade 106 may vary depending on the design of the chambered recesses.

It is commonly known that wiper blades inherently wear as they may be constantly in contact with the surface of the carrying mechanism. Because of this, it may be advantageous to minimize the effect of part failure by adding additional contact points to the system, whether it is additional wiper blades or additional wiping surfaces of the wiper blades. In some aspects, three points of contact may be most advantageous. The first contact point may be used as a primary contact point in directing the quantity of the medium into the chambered recesses, the second contact point may be used as a secondary contact point in directing the quantity of the medium into the chambered recesses, and a third contact point may be used as a tertiary contact point or safety net catching any stray media. More contact points may be used in the system to decrease likelihood of contamination, but finite space may limit the number of contact points utilized (e.g., number of wiper blades or surfaces).

In some aspects, for example, the system 100 may comprise more than one wiper blade 106 in order to provide additional contact points therein. FIGS. 2-8 illustrate various embodiments of systems where there are advantageously three wiper blades in each system. However, there may be one, two, three, four, five, six, etc., wiper blades in a system.

In some other aspects, for example, the system 100 may comprise a wiper blade 106 defining one or more distinct surfaces in order to provide additional contact points therein, while also increasing the effectiveness of the wiper blades. More particularly, additional surfaces or contact points may increase the effectiveness of the wiper blade 106. For example, the wiper blade 106 defining one distinct surface may be about 90% effective in directing a quantity of a medium into a specified chambered recess. Increasing the distinct surfaces defined thereby may increase the effectiveness of the wiper blade, such that a wiper blade defining more than one distinct surface may be about 98% effective in directing a quantity of a medium into a specified chambered recess. A shape of the distinct surface may also have an impact on the effectiveness of the wiper blade. FIGS. 2-8 illustrate various embodiments of systems where there are one, two, three, and four distinct surfaces in each wiper blade. The surfaces of the wiper blade may be curvilinear surfaces or may be other types of surfaces such as, for example, a rectilinear surface. FIG. 7 illustrates wiper blades defining both curvilinear and rectilinear surfaces.

In some further aspects, the surfaces of the wiper blade may comprise at least one wiping material, such as, for example, a compression molded carbon (e.g., ethylene propylene diene monomer (EPDM) rubber). Where there is more than one distinct surface in each wiper blade, the distinct surfaces may comprise a same or similar wiper material or may be a different wiper material.

Location of the wiper blade 106 may vary along the carrying mechanism 102. It may be advantageous to locate the primary or first wiper blade after the primary or first dispensing nozzle (e.g., dispensing nozzle 104) along the machine direction of the carrying mechanism. For example, where the carrying mechanism comprises a rotating drum, it may be advantageous to locate the primary or first wiper blade between about 270 degrees and about 90 degrees relative to the center of the cylindrical surface of the rotating drum if the first dispensing nozzle is disposed between about 345 degrees and about 15 degrees relative to a center of the cylindrical surface. In this example, it may be beneficial to dispose a first wiper blade within 10 degrees after a first dispensing nozzle along the machine direction, where the first dispensing nozzle is disposed between about 345 degrees and about 15 degrees relative to a center of the cylindrical surface.

Any secondary or second wiper blade may be located before the primary or first dispensing nozzle (e.g., dispensing nozzle 104) along the machine direction of the carrying mechanism 102. For example, the second wiper blade may be disposed behind the first dispensing nozzle where the first dispensing nozzle is disposed anywhere between about 0 degrees and about 90 degrees relative to a center of the cylindrical surface. In this manner, the second wiper blade may be configured to contain any media that is ejected out of the respective chambered recesses by gravitational forces overcoming frictional forces. Notably, it may be advantageous to use a secondary wiper blade behind any dispensing nozzle that deviates more than 2 degrees from the center of the cylindrical surface of the rotating drum. Additional wiper blades, such as third, fourth, fifth, sixth, etc., may be located before or after additional dispensing nozzles along the machine direction where these dispensing nozzles deviate more than 2 degrees from the center.

In some aspects, where more than one wiper blade is utilized (e.g., through use of two or more dispensing nozzles or placement of dispensing nozzles from about 0 degrees to about 90 degrees) the curvilinear surfaces of the wiper blades behind the dispensing nozzles (in respect to the machine direction) may be aligned with the curvilinear surfaces of the wiper blades after the dispensing nozzles. For example, where there are three wiper blades utilized in the system 100, the first and third wiper blades may comprise aligned curvilinear surfaces, while the second wiper blade may be mirrored relative to the first and third wiper blades in the cross-machine direction. In some other examples, the second wiper blade may be offset in the cross-machine direction relative to the first and third wiper blades by a certain amount, e.g., by half a wavelength.

In some aspects, the wiper blade 106 may comprise a compressive force urging the wiper blade against the surface of the carrying mechanism 102. For example, a spring, a clamp, or other resilient member may be used to urge the wiper blade into a disposition adjacent to or in contact with the surface of the carrying mechanism. More particularly, the wiper blade may be in direct contact with the surface of the carrying mechanism. A resilient member, such as a spring, may advantageously continue to exert compressive force against the wiper blade 106 and urge it against the surface of the carrying mechanism even as the wiping material of the wiper blade 106 wears. While a system 100 may use individual compressive forces (e.g., individual resilient members) per wiper blade, the wiper blade(s) may be designed in such a manner that only one resilient member for all of the wiper blade(s) is sufficient.

The controller 108 may be configured to control one or both of the carrying mechanism 102 and the dispensing nozzle 104. Moreover, two separate controllers may be used to control the carrying mechanism 102 and the dispensing nozzle 104. The controller 108 may generally be configured to control the dispensing nozzle 104 to dispense a quantity of a medium (e.g., a quantity of a first medium) onto the surface of the carrying mechanism 102 for direction into the chambered recesses in a group of the chambered recesses defined about the surface of the carrying mechanism. The controller may be configured to also control the carrying mechanism. In this manner, the quantity of the medium may be dispensed during a predetermined fill-window, defined when the chambered recesses are substantially aligned with the dispensing nozzle, after a certain time period, as determined by sensors monitoring a distance of travel of the carrying mechanism, etc. The controller 108 may comprise a hardware processor and a memory, as well as any further elements (e.g., sensors, scanners, input devices, etc.) that may be useful in carrying out a filling method as otherwise described herein.

Figure 2:
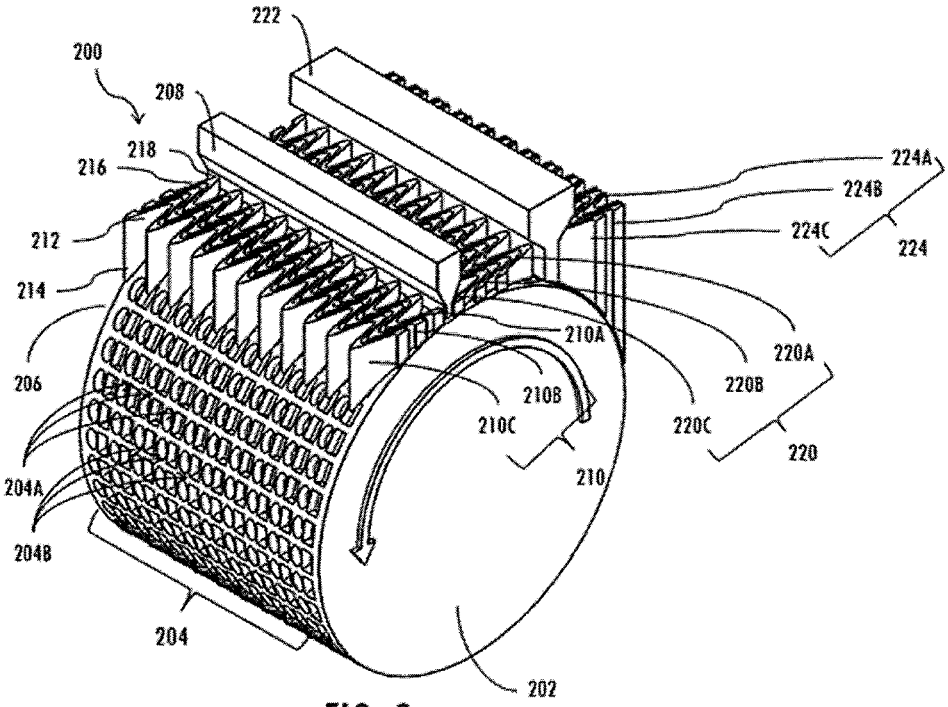
FIGS. 2-4 illustrate an exemplary system for filling a chambered package, where a carrying mechanism is a rotating drum and a wiper blade defines a curvilinear surface configured to direct a quantity of a medium into every other chambered recess according to various aspects of the present disclosure.
Figure 3:
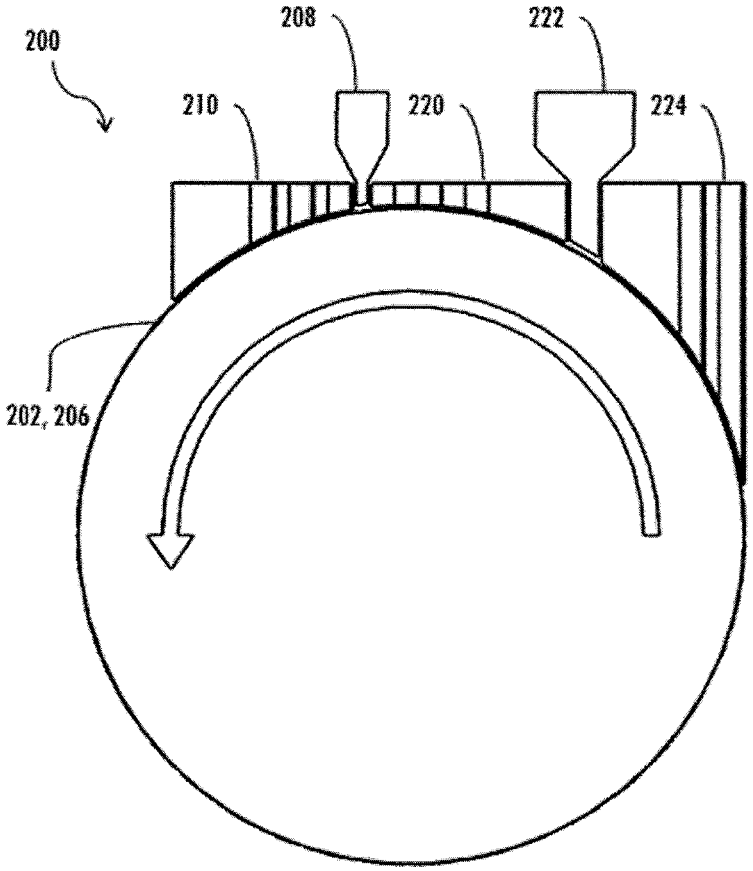
Figure 4:
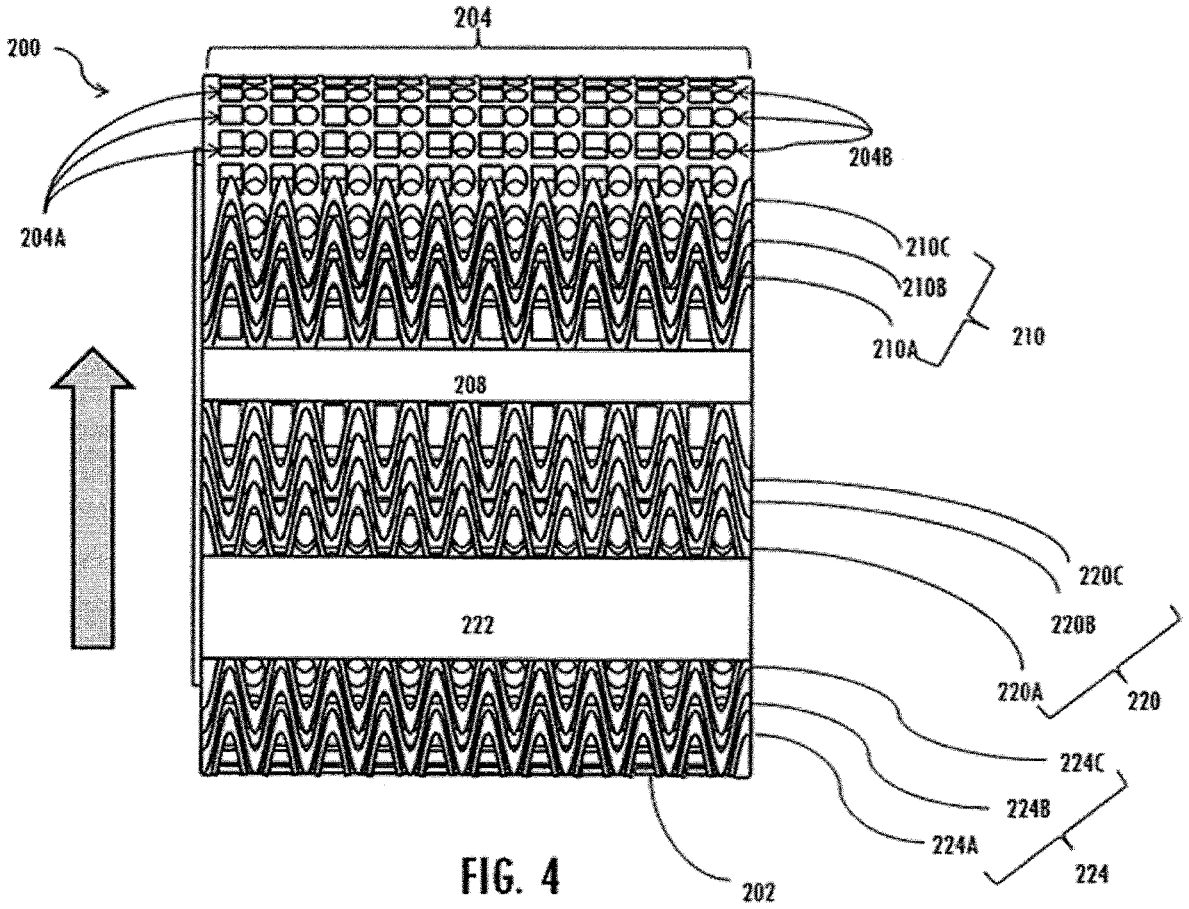

Referring now to FIGS. 2-4, an example embodiment of a system 200 for filling a chambered package is illustrated. The system includes a carrying mechanism 202 travelling in a machine direction and having chambered recesses 204 defined about a surface 206 thereof. The carrying mechanism illustrated in FIGS. 2-4 is a rotating drum having a cylindrical surface, such that the machine direction is counter-clockwise. A clockwise machine direction is also contemplated, however. Thus, the chambered recesses are defined in the cylindrical surface of the rotating drum with a length extending in the machine direction and a width extending in a cross-machine direction.

A first dispensing nozzle 208 configured to dispense a quantity of a medium (not shown) onto the surface 206 of the carrying mechanism 202 for direction into the chambered recesses in a first group of the chambered recesses 204A defined about the surface of the carrying mechanism is also illustrated in FIGS. 2-4. The first dispensing nozzle is illustrated at a location along the carrying mechanism in the machine direction of about 355 degrees relative to a center of the surface. The first dispensing nozzle may be in communication with a first hopper or other feed mechanism that feeds the first dispensing nozzle the medium. A valve (not shown) or other control mechanism (e.g., controller 108) may be configured to control a flow of the medium received by the first dispensing nozzle such that the quantity of the medium dispensed by the dispensing nozzle is metered out when the chambered recesses in the first group of chambered recesses is aligned with the first dispensing nozzle.

A first wiper blade 210 may be disposed along the carrying mechanism 202 in the machine direction after the first dispensing nozzle 208. The first wiper blade is illustrated at a location along the carrying mechanism in the machine direction of about 350 degrees relative to a center of the surface. The first wiper blade may define a curvilinear surface having crests 212 with peaks 214 aligned with centerlines of the chambered recesses in the first group of the chambered recesses, the centerlines being parallel to the machine direction. The curvilinear surface may also have troughs 216 with apices 218 tangential to a midpoint of a width in a cross-machine direction of the chambered recesses in a second group of the chambered recesses. In this manner, the curvilinear surface of the first wiper blade may define a sinusoidal waveform having continuously alternating crests and troughs. The crests may be configured to direct the quantity of the medium into the chambered recesses in the first group of the chambered recesses 204A as the carrying mechanism moves in the machine direction (i.e., counter-clockwise). The troughs may be configured to direct the quantity of the medium away from entering the chambered recesses in the second group of the chambered recesses 204B as the carrying mechanism moves in the machine direction. In this manner, the second group of the chambered recesses may be different than the first group of the chambered recesses.

In some aspects, the first wiper blade 210 may define three distinct curvilinear surfaces 210A-210C configured to be aligned with one another such that crests of each of the curvilinear surfaces have aligned peaks and troughs of each of the curvilinear surfaces have aligned apices. This may advantageously increase the number of contact points that the wiper blade 210 defines such that effect of wear of the wiper blade on the system is minimized.

A second wiper blade 220 may be disposed along the carrying mechanism 202 in the machine direction before the first dispensing nozzle 208. The second wiper blade is illustrated at a location along the carrying mechanism in the machine direction of about 5 degrees relative to a center of the surface. As illustrated, the second wiper blade may define a curvilinear surface that is mirrored relative to the first blade in the cross-machine direction so as to contain the quantity of the medium in the chambered recesses in the first group of the chambered recesses 204A. For example, and as illustrated in FIGS. 2-4, the second wiper blade may be a mirror image of the first wiper blade relative to the cross-machine direction. Alternatively, the second wiper blade may be offset relative to the first wiper blade, for example, by half a wavelength relative to the first wiper blade. However, the offset of the second wiper blade relative to the first wiper blade may vary depending on the filling operation of the system. More specifically, depending on a size, shape, type of media dispensed, etc., the offset of the second wiper blade may vary in order to most efficiently complement the design of the chambered recesses.

The second wiper blade 220 may define a curvilinear surface having crests with peaks aligned with the centerlines of the chambered recesses in the second group of the chambered recesses 204B, the centerlines being parallel to the machine direction. The crests may thus be configured to contain the quantity of the medium dispensed from the first dispensing nozzle 208 in the chambered recesses in the first group of the chambered recesses 204A. The curvilinear surface of the second wiper blade may also have troughs with apices tangential to the midpoint of the width in the cross-machine direction of the chambered recesses in the first group of the chambered recesses.

In some aspects, the second wiper blade 220 may define three distinct curvilinear surfaces 220A-220C configured to be aligned with one another such that crests of each of the curvilinear surfaces have aligned peaks and troughs of each of the curvilinear surfaces have aligned apices. This may advantageously increase the number of contact points that the wiper blade 220 defines such that effect of wear of the wiper blade on the system is minimized.

A second dispensing nozzle 222 may be disposed along the carrying mechanism 202 in the machine direction before the first dispensing nozzle 208 and the second wiper blade 220. The second dispensing nozzle is illustrated at a location along the carrying mechanism in the machine direction of about 15 degrees relative to a center of the surface. The second dispensing nozzle may be configured to dispense a quantity of a medium on the surface of the carrying mechanism for direction into the chambered recesses in the second group of the chambered recesses 204B defined about the surface 206 of the carrying mechanism. The quantity of the medium dispensed from the second dispensing nozzle may be the same as or different than the quantity of the medium dispensed from the first dispensing nozzle.

The second wiper blade 220 is thus utilized not only to contain the quantity of the medium dispensed from the first dispensing nozzle 208 in the chambered recesses in the first group of chambered recesses 204A, but is also used for directing the quantity of the medium dispensed from the second dispensing nozzle 222 into the chambered recesses in the second group of chambered recesses 204B. More particularly, for example, the crests of the second wiper blade may be configured to direct the quantity of the medium dispensed from the second dispensing nozzle into the chambered recesses in the second group of the chambered recesses and the troughs of the second wiper blade may be configured to direct the quantity of the medium dispensed from the second dispensing nozzle away from entering the chambered recesses in the first group of the chambered recesses.

A third wiper blade 224 may be disposed along the carrying mechanism 202 in the machine direction before the second dispensing nozzle 222. The third wiper blade is illustrated at a location along the carrying mechanism in the machine direction of about 30 degrees relative to a center of the surface. As illustrated, the third wiper blade may define a curvilinear surface in alignment with the first wiper blade 210 and mirrored relative to the second wiper blade in the cross-machine direction so as to contain the quantity of the medium dispensed from the second dispensing nozzle in the chambered recesses in the second group of the chambered recesses 204B. For example, and as illustrated in FIGS. 2-4, the third wiper blade may be aligned with the first wiper blade, such that the second wiper blade may be mirrored in the cross-machine direction relative to the first wiper blade and the third wiper blade.

The third wiper blade 224 may define a curvilinear surface having crests with peaks aligned with the centerlines of the chambered recesses in the first group of the chambered recesses 204A, the centerlines being parallel to the machine direction. The crests may thus be configured to contain the quantity of the medium dispensed from the second dispensing nozzle 222 in the chambered recesses in the second group of the chambered recesses 204B. The curvilinear surface of the third wiper blade may also have troughs with apices tangential to the midpoint of the width in the cross-machine direction of the chambered recesses in the second group of the chambered recesses.

In some aspects, the third wiper blade 224 may define three distinct curvilinear surfaces 224A-224C configured to be aligned with one another such that crests of each of the curvilinear surfaces have aligned peaks and troughs of each of the curvilinear surfaces have aligned apices. This may advantageously increase the number of contact points that the wiper blade 224 defines such that effect of wear of the wiper blade on the system is minimized.

Thus, the system 200 defines a system for filling a chambered package where every other chambered recess is filled with substantially the same quantity of a medium such that the chambers have a pattern of AB AB AB AB AB, with A referring to the first group of chambered recesses 204A and B referring to the second group of chambered recesses 204B. The wiper blades 210, 220, and 224 in the system are configured with amplitudes and wavelengths such that the quantity of the medium dispensed is contained in the intended chamber and directed away from the unintended chamber.

Figure 5:
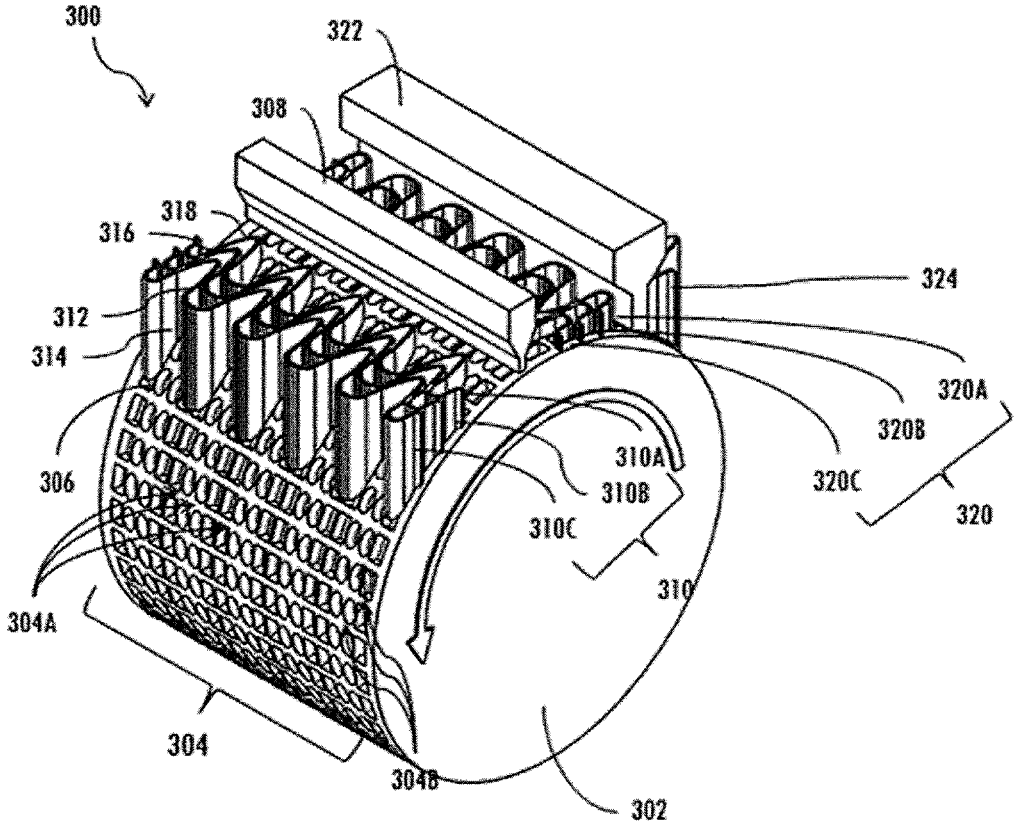
FIGS. 5-6 illustrate an exemplary system for filling a chambered package, where a carrying mechanism is a rotating drum and a wiper blade defines a curvilinear surface configured to direct a quantity of a medium into every two chambered recesses according to various aspects of the present disclosure.
Figure 6:
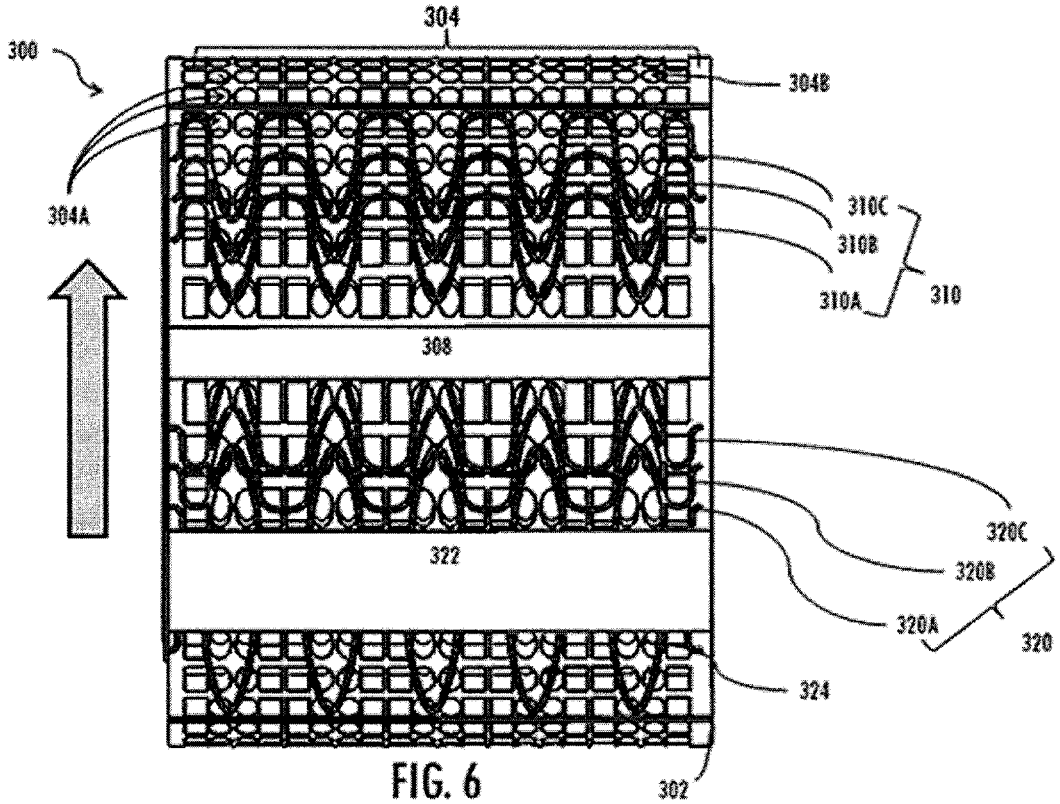
Figure 7:
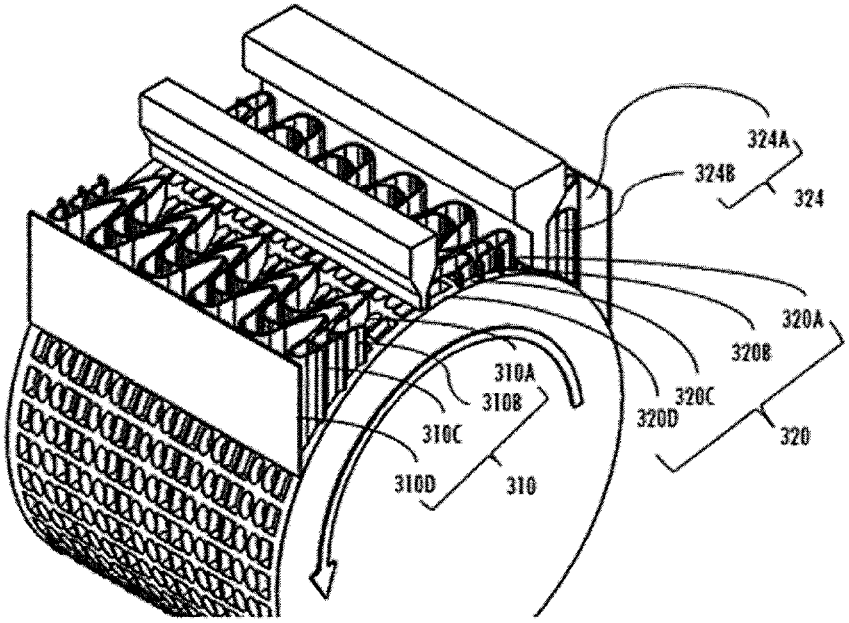
FIG. 7 illustrates the system of FIGS. 5-6 where the wiper blade further defines a rectilinear surface according to various aspects of the present disclosure.

Referring now to FIGS. 5-6, another example embodiment of a system 300 for filling a chambered package is illustrated. The system includes a carrying mechanism 302 travelling in a machine direction and having chambered recesses 304 defined about a surface 306 thereof. The carrying mechanism illustrated in FIGS. 5-6 is a rotating drum having a cylindrical surface, such that the machine direction is counter-clockwise. A clockwise machine direction is also contemplated, however. Thus, the chambered recesses are defined in the cylindrical surface of the rotating drum with a length extending in the machine direction and a width extending in a cross-machine direction.

A first dispensing nozzle 308 configured to dispense a quantity of a medium (not shown) onto the surface 306 of the carrying mechanism 302 for direction into the chambered recesses in a first group of the chambered recesses 304A defined about the surface of the carrying mechanism is also illustrated in FIGS. 5-6. The first dispensing nozzle is illustrated at a location along the carrying mechanism in the machine direction of about 355 degrees relative to a center of the surface. The first dispensing nozzle may be in communication with a first hopper or other feed mechanism that feeds the first dispensing nozzle the medium. A first wiper blade 310 may be disposed along the carrying mechanism in the machine direction after the first dispensing nozzle. The first wiper blade is illustrated at a location along the carrying mechanism in the machine direction of about 350 degrees relative to a center of the surface.

The first wiper blade 310 may define a curvilinear surface having crests 312 with peaks 314 aligned with centerlines of the chambered recesses in the first group of the chambered recesses 304A, the centerlines being parallel to the machine direction. The curvilinear surface may also have troughs 316 with apices 318 tangential to a midpoint of a width in a cross-machine direction between two of the chambered recesses in a second group of the chambered recesses 304B. In this manner, the curvilinear surface of the first wiper blade may define a sinusoidal waveform having continuously alternating crests and troughs. The crests may be configured to direct the quantity of the medium into the chambered recesses in the first group of the chambered recesses as the carrying mechanism moves in the machine direction (i.e., counter-clockwise). The troughs may be configured to direct the quantity of the medium away from entering the chambered recesses in the second group of the chambered recesses as the carrying mechanism moves in the machine direction. In this manner, the second group of the chambered recesses may be different than the first group of the chambered recesses.

In some aspects, the first wiper blade 310 may define three distinct curvilinear surfaces 310A-310C configured to be aligned with one another such that crests of each of the curvilinear surfaces have aligned peaks and troughs of each of the curvilinear surfaces have aligned apices. This may advantageously increase the number of contact points that the wiper blade 310 defines such that effect of wear of the wiper blade on the system is minimized.

A second wiper blade 320 may be disposed along the carrying mechanism 302 in the machine direction before the first dispensing nozzle 308. The second wiper blade is illustrated at a location along the carrying mechanism in the machine direction of about 5 degrees relative to a center of the surface. As illustrated, the second wiper blade may define a curvilinear surface that is mirrored in the cross-machine direction relative to the first wiper blade 310 so as to contain the quantity of the medium in the chambered recesses in the first group of the chambered recesses 304A. For example, and as illustrated in FIGS. 5-6, the second wiper blade may be a mirror image of the first wiper blade relative to the cross-machine direction.

The second wiper blade 320 may define a curvilinear surface having crests with peaks aligned between two chambered recesses in the second group of the chambered recesses 304B, the centerlines being parallel to the machine direction. The crests may thus be configured to contain the quantity of the medium dispensed from the first dispensing nozzle 308 in the chambered recesses in the first group of the chambered recesses 304A. The curvilinear surface of the second wiper blade may also have troughs with apices tangential to the midpoint of the width in the cross-machine direction of the chambered recesses in the first group of the chambered recesses.

In some aspects, the second wiper blade 320 may define three distinct curvilinear surfaces 320A-320C configured to be aligned with one another such that crests of each of the curvilinear surfaces have aligned peaks and troughs of each of the curvilinear surfaces have aligned apices. This may advantageously increase the number of contact points that the wiper blade 320 defines such that effect of wear of the wiper blade on the system is minimized.

A second dispensing nozzle 322 may be disposed along the carrying mechanism 302 in the machine direction before the first dispensing nozzle 308 and the second wiper blade 320. The second dispensing nozzle is illustrated at a location along the carrying mechanism in the machine direction of about 15 degrees relative to a center of the surface. The second dispensing nozzle may be configured to dispense a quantity of a medium on the surface of the carrying mechanism for direction into the chambered recesses in the second group of the chambered recesses 304B defined about the surface 306 of the carrying mechanism. The quantity of the medium dispensed from the second dispensing nozzle may be the same as or different than the quantity of the medium dispensed from the first dispensing nozzle.

The second wiper blade 320 is thus utilized not only to contain the quantity of the medium dispensed from the first dispensing nozzle 308 in the chambered recesses in the first group of chambered recesses 304A, but is also used for directing the quantity of the medium dispensed from the second dispensing nozzle 322 into the chambered recesses in the second group of chambered recesses 304B. More particularly, for example, the crests of the second wiper blade may be configured to direct the quantity of the medium dispensed from the second dispensing nozzle into the chambered recesses in the second group of the chambered recesses and the troughs of the second wiper blade may be configured to direct the quantity of the medium dispensed from the second dispensing nozzle away from entering the chambered recesses in the first group of the chambered recesses.

A third wiper blade 324 may be disposed along the carrying mechanism 302 in the machine direction before the second dispensing nozzle 322. The third wiper blade is illustrated at a location along the carrying mechanism in the machine direction of about 20 degrees relative to a center of the surface. As illustrated, the third wiper blade may define a curvilinear surface in alignment with the first wiper blade 310 and mirrored relative to the second wiper blade in the cross-machine direction so as to contain the quantity of the medium dispensed from the second dispensing nozzle in the chambered recesses in the second group of the chambered recesses 304B. For example, and as illustrated in FIGS. 5-6, the third wiper blade may be aligned with the first wiper blade, such that the second wiper blade may be mirrored in the cross-machine direction relative to the first wiper blade and the third wiper blade.

The third wiper blade 324 may define a curvilinear surface having crests with peaks aligned with the centerlines of the chambered recesses in the first group of the chambered recesses 304A, the centerlines being parallel to the machine direction. The crests may thus be configured to contain the quantity of the medium dispensed from the second dispensing nozzle 322 in the chambered recesses in the second group of the chambered recesses 304B. The curvilinear surface of the third wiper blade may also have troughs with apices tangential to the midpoint of the width in the cross-machine direction between two chambered recesses in the second group of the chambered recesses. In some aspects, the third wiper blade 324 defines only a single curvilinear surface, as compared with the first wiper blade 310 and the second wiper blade 320. This is because the third wiper is configured to catch any stray medium that falls in the wrong direction. Notably, as the second dispensing nozzle is disposed farther from the center of the rotating drum, it may be advantageous to employ more wiper blades in the system 100 as there may be an increased likelihood that more media may fall in the wrong direction, i.e., not in the intended recessed chamber.

Thus, the system 300 defines a system for filling a chambered package where every two chambered recesses are filled with a same quantity of a medium (with the exception of the first and last chambered recess in each row relative to the cross-machine direction) such that the chambers have a pattern of AB BA AB BA AB, with A referring to the first group of chambered recesses 304A and B referring to the second group of chambered recesses 304B. The wiper blades 310, 320, and 324 in the system are configured with amplitudes and wavelengths such that the quantity of the medium dispensed is contained in the intended chamber and directed away from the unintended chamber.

FIG. 7 illustrates an alternate embodiment of the system 300 as illustrated in FIGS. 5-6. In FIG. 7, each of the wiper blades 310, 320, and 324 define a rectilinear surface in addition to the curvilinear surfaces defined thereby. The use of a rectilinear surface at an edge (e.g., trailing edge and/or leading edge) of the wiper blades may provide a good seal for the chambered package by indiscriminately wiping the quantity of the medium into a chambered recess. More particularly, for example, the first wiper blade defines a rectilinear surface 310D. The rectilinear surface of the first wiper blade is in contact with the peaks 314 of the third curvilinear surface 310C defined by the first wiper blade. The second wiper blade defines a rectilinear surface 320D. The rectilinear surface of the second wiper blade is in contact with the peaks of the third curvilinear surface 320C defined by the second wiper blade. The third wiper blade defines a rectilinear surface 324A. The rectilinear surface of the third wiper blade is in contact with the apices of the curvilinear surface 324B defined by the third wiper blade.

FIG. 8 illustrates a system, generally referred to as 400, having components similar to those illustrated in FIGS. 2-7. The system differs in that the carrying mechanism rather than being a rotating drum or other similar curved carrying mechanism is a flatbed carrying mechanism 402. The flatbed carrying mechanism may be configured to travel in a machine direction and may have chambered recesses 404 defined about a surface 406 thereof. A first dispensing nozzle 408 may be configured to dispense a quantity of a medium onto the surface of the carrying mechanism for direction into the chambered recesses in a first group of the chambered recesses 404A defined about the surface of the carrying mechanism. A first wiper blade 410 may be disposed along the carrying mechanism in the machine direction after the first dispensing nozzle, the first wiper blade defining a curvilinear surface having crests 412 with peaks 414 aligned with centerlines of the chambered recesses in the first group of the chambered recesses, the centerlines being parallel to the machine direction. The crests of the curvilinear surface may be configured to direct the quantity of the medium into the chambered recesses in the first group of the chambered recesses. The curvilinear surface may also have troughs 416 with apices 418 tangential to a midpoint of a width in a cross-machine direction of the chambered recesses in a second group of the chambered recesses 404B. The troughs of the curvilinear surface may be configured to direct the quantity of the medium away from entering the chambered recesses in the second group of the chambered recesses. In some aspects, FIG. 8 includes an additional dispensing nozzle, second dispensing nozzle 422 and additional wiper blades, second wiper blade 420 and third wiper blade 424.

FIG. 9 illustrates a method for filling a chambered package, generally 500. The method comprises dispensing a quantity of a medium from a first dispensing nozzle onto a surface of a carrying mechanism travelling in a machine direction for direction into chambered recesses in a first group of the chambered recesses defined about a surface of the carrying mechanism, in step 502.

The method further comprises directing, using a first wiper blade disposed along the carrying mechanism in the machine direction after the first dispensing nozzle, the quantity of the medium into the chambered recesses in the first group of the chambered recesses, the first wiper blade defining a curvilinear surface having crests with peaks aligned with centerlines of the chambered recesses in the first group of the chambered recesses, the centerlines being parallel to the machine direction, in step 504.

The method further comprises directing the quantity of the medium away from entering chambered recesses in a second group of the chambered recesses using the first wiper blade defining the curvilinear surface having troughs with apices tangential to a midpoint of a width of each of the chambered recesses in the second group of the chambered recesses in a cross-machine direction, in step 506.

The system and method disclosed herein resolves issues that may be present in current technical solutions for filling chambered packages because the wiper blade, in particular, provides a focused product stream that minimizes product waste, reduces wear on components of the system and reduces maintenance frequency and associated downtimes. The number of components in the design of the wiper blade also simplifies designs compared with other current technical solutions thereby reducing maintenance and operation costs. Further, the system and method disclosed herein are entirely flexible due to the design and prototyping used. More particularly, rapid prototyping to quickly fabricate a scale model of the wiper blade using computer aided design software in conjunction with a 3D printing or other additive layer manufacturing technology reduces lead time to days versus weeks, increases operational and design flexibility by lending itself to complex geometric designs not easily recreated using conventional machining techniques, increases speed and lowers cost to trial. Therefore, the system and method disclosed herein provide a solution to the problem of filling chambered packages.

Many modifications and other embodiments of the disclosure set forth herein will come to mind to one skilled in the art to which these disclosure pertain having the benefit of the teachings presented in the foregoing descriptions. Therefore, it is to be understood that the disclosure is not to be limited to the specific embodiments disclosed and that modifications and other embodiments are intended to be included within the scope of the appended claims Although specific terms are employed herein, they are used in a generic and descriptive sense only and not for purposes of limitation

The invention claimed is:

1. A system for filling a chambered package, the system comprising:

a carrying mechanism travelling in a machine direction and having chambered recesses defined about a surface thereof;

a first dispensing nozzle configured to dispense a quantity of a medium onto the surface of the carrying mechanism for direction into the chambered recesses in a first group of the chambered recesses defined about the surface of the carrying mechanism; and a first wiper blade disposed along the carrying mechanism in the machine direction after the first dispensing nozzle, the first wiper blade defining a curvilinear surface having crests with peaks aligned with centerlines of the chambered recesses in the first group of the chambered recesses, the centerlines being parallel to the machine direction, the crests being configured to direct the quantity of the medium into the chambered recesses in the first group of the chambered recesses, and the curvilinear surface having troughs with apices tangential to a midpoint of a width in a cross-machine direction of the chambered recesses in a second group of the chambered recesses, the troughs being configured to direct the quantity of the medium away from entering the chambered recesses in the second group of the chambered recesses.

2. The system of claim 1, further comprising a second wiper blade disposed along the carrying mechanism in the machine direction before the first dispensing nozzle, the second wiper blade defining a curvilinear surface that is mirrored in the cross-machine direction relative to the first wiper blade so as to contain the quantity of the medium in the chambered recesses in the first group of the chambered recesses.

3. The system of claim 2, wherein the curvilinear surface of the second wiper blade has crests with peaks aligned with the centerlines of the chambered recesses in the second group of the chambered recesses, the centerlines being parallel to the machine direction, the crests being configured to contain the quantity of the medium in the chambered recesses in the first group of the chambered recesses, and the curvilinear surface of the second wiper blade has troughs with apices tangential to the midpoint of the width in the cross-machine direction of the chambered recesses in the first group of the chambered recesses.

4. The system of claim 3, further comprising a second dispensing nozzle disposed along the carrying mechanism in the machine direction before the first dispensing nozzle and the second wiper blade, the second dispensing nozzle being configured to dispense a quantity of a medium on the surface of the carrying mechanism for direction into the chambered recesses in the second group of the chambered recesses defined about the surface of the carrying mechanism, wherein the crests of the second wiper blade are configured to direct the quantity of the medium dispensed from the second dispensing nozzle into the chambered recesses in the second group of the chambered recesses and the troughs of the second wiper blade are configured to direct the quantity of the medium dispensed from the second dispensing nozzle away from entering the chambered recesses in the first group of the chambered recesses, and wherein the second group of the chambered recesses is different than the first group of the chambered recesses.

5. The system of claim 4, further comprising a third wiper blade disposed along the carrying mechanism in the machine direction before the second dispensing nozzle, the third wiper blade defining a curvilinear surface in alignment with the first wiper blade and mirrored in the cross-machine direction to the second wiper blade so as to contain the quantity of the medium dispensed from the second dispensing nozzle in the chambered recesses in the second group of the chambered recesses.

6. The system of claim 5, wherein the curvilinear surface of the third wiper blade has crests with peaks aligned with centerlines of the chambered recesses in the first group of the chambered recesses parallel to the machine direction, the crests being configured to contain the quantity of the medium in the chambered recesses in the second group of the chambered recesses, and the curvilinear surface of the third wiper blade has troughs with apices tangential to the midpoint of the width of each of the chambered recesses in the second group of the chambered recesses in the cross-machine direction.

7. The system of claim 1, wherein the curvilinear surface of the first wiper blade comprises an amplitude of at least half a length of each of the chambered recesses relative to the machine direction, and comprises a wavelength at most a width of each of the chambered recesses relative to the cross-machine direction.

8. The system of claim 1, wherein the curvilinear surface of the first wiper blade defines a sinusoidal waveform.

9. The system of claim 1, wherein the carrying mechanism comprises a rotating drum having a cylindrical surface or the carrying mechanism comprises a flatbed conveyor having a planar surface.

10. The system of claim 9, wherein the first dispensing nozzle is disposed between about 345 degrees and about 15 degrees relative to a center of the cylindrical surface and the first wiper blade is disposed between about 270 degrees and about 90 degrees relative to the center of the cylindrical surface.

11. The system of claim 1, wherein the first wiper blade defines three distinct curvilinear surfaces configured to be aligned such that crests of each of the curvilinear surfaces have aligned peaks and troughs of each of the curvilinear surfaces have aligned apices.

12. The system of claim 1, wherein the first wiper blade further defines a rectilinear surface extending substantially perpendicularly to the crests and troughs of the curvilinear surface of the first wiper blade in the cross-machine direction, the rectilinear surface being in contact with the peaks of the curvilinear surface.

13. A method for filling a chambered package, the method comprising:

dispensing a quantity of a medium from a first dispensing nozzle onto a surface of a carrying mechanism travelling in a machine direction for direction into chambered recesses in a first group of the chambered recesses defined about a surface of the carrying mechanism;

directing, using a first wiper blade disposed along the carrying mechanism in the machine direction after the first dispensing nozzle, the quantity of the medium into the chambered recesses in the first group of the chambered recesses, the first wiper blade defining a curvilinear surface having crests with peaks aligned with centerlines of the chambered recesses in the first group of the chambered recesses, the centerlines being parallel to the machine direction; and directing the quantity of the medium away from entering chambered recesses in a second group of the chambered recesses using the first wiper blade defining the curvilinear surface having troughs with apices tangential to a midpoint of a width of each of the chambered recesses in the second group of the chambered recesses in a cross-machine direction.

14. The method of claim 13, further comprising containing the quantity of the medium in the chambered recesses in the first group of the chambered recesses, using a second wiper blade disposed along the carrying mechanism in the machine direction before the first dispensing nozzle, the second wiper blade defining a curvilinear surface that is mirrored in the cross-machine direction relative to the first wiper blade.

15. The method of claim 14, wherein containing the quantity of the medium in the chambered recesses in the first group of the chambered recesses using the second wiper blade comprises mirroring the curvilinear surface of the second wiper blade relative to the first wiper blade in the cross-machine direction such that the second wiper blade has crests with peaks aligned with the centerlines of the chambered recesses in the second group of the chambered recesses, the centerlines being parallel to the machine direction, the crests being configured to contain the quantity of the medium in the chambered recesses in the first group of the chambered recesses, and the curvilinear surface of the second wiper blade has troughs with apices tangential to the midpoint of the width in the cross-machine direction of the chambered recesses in the first group of the chambered recesses.

16. The method of claim 14, further comprising:

dispensing a quantity of a medium from a second dispensing nozzle onto the surface of the carrying mechanism travelling in the machine direction for direction into the chambered recesses in the second group of the chambered recesses defined about the surface of the carrying mechanism;

directing, using the second wiper blade, the quantity of the medium dispensed from the second dispensing nozzle into the chambered recesses in the second group of the chambered recesses; and directing the quantity of the medium dispensed from the second dispensing nozzle away from entering the chambered recesses in the first group of the chambered recesses using the troughs of the second wiper blade;

wherein the second group of the chambered recesses is different than the first group of the chambered recesses.

17. The method of claim 16, further comprising containing, using a third wiper blade disposed along the carrying mechanism in the machine direction before the second dispensing nozzle, the quantity of the medium dispensed from the second dispensing nozzle in the chambered recesses in the second group of the chambered recesses, the third wiper blade defining a curvilinear surface in alignment with the first wiper blade and mirrored in the cross-machine direction to the second wiper blade so as to contain the quantity of the medium dispensed from the second dispensing nozzle in the chambered recesses in the second group of the chambered recesses.

18. The method of claim 17, wherein containing the quantity of the medium in the chambered recesses in the second group of the chambered recesses using the third wiper blade comprises mirroring the third wiper blade in the cross-machine direction relative to the second wiper blade and aligning the third wiper blade in the cross-machine direction with the first wiper blade so that the curvilinear surface of the third wiper blade has crests with peaks aligned with centerlines of the chambered recesses in the first group of the chambered recesses, the centerlines being parallel to the machine direction, the crests being configured to contain the quantity of the medium in the chambered recesses in the second group of the chambered recesses, and the curvilinear surface of the third wiper blade has troughs with apices tangential to the midpoint of the width of each of the chambered recesses in the second group of the chambered recesses in the cross-machine direction.

* * * * *